US006799624B2

(12) United States Patent
Smith

(10) Patent No.: US 6,799,624 B2
(45) Date of Patent: Oct. 5, 2004

(54) MINI-BLIND APPARATUS

(75) Inventor: Brian W Smith, Evansville, WI (US)

(73) Assignee: Advanced Innovations, LLC., Reedsburg, WI (US)

( * ) Notice: Subject to any disclaimer, the term of this patent is extended or adjusted under 35 U.S.C. 154(b) by 0 days.

(21) Appl. No.: 10/429,269

(22) Filed: May 2, 2003

(65) Prior Publication Data

US 2004/0069418 A1 Apr. 15, 2004

Related U.S. Application Data

(63) Continuation-in-part of application No. 09/977,447, filed on Oct. 15, 2001, now Pat. No. 6,557,615.

(51) Int. Cl.[7] ..... E06B 9/30
(52) U.S. Cl. ..... 160/176.1 R; 160/178.3
(58) Field of Search ..... 160/168.1 R, 173 R, 160/176.1 R, 177 R, 178.3, 236, 178.1 R

(56) References Cited

U.S. PATENT DOCUMENTS 1,590,886 A * 6/1926 Ferdinando ..... 160/176.1 R
2,583,449 A * 1/1952 Tarnoff ..... 160/170
5,375,642 A * 12/1994 Gaber et al. ..... 160/168.1 R
5,409,050 A * 4/1995 Hong ..... 160/168.1 R
6,405,783 B1 * 6/2002 Smith ..... 160/176.1 R
6,557,615 B2 * 5/2003 Smith ..... 160/176.1 R
2003/0192656 A1 * 10/2003 Burgess ..... 160/176.1 R

* cited by examiner

*Primary Examiner*—Blair M. Johnson
(74) *Attorney, Agent, or Firm*—David J. Archer

(57) ABSTRACT

A mini-blind apparatus is disclosed having a first horizontal slat and a second slat disposed spaced and parallel relative to the first slat. The apparatus includes a first tab having a first and a second end, the first end of the first tab being secured to a rearward edge of the first slat, the first tab defining a first and a second cage. The first cage is disposed between the first and the second end of the first tab and a first control has a first bead secured thereto for entrapment thereof within the first cage. The second cage is disposed between the first cage and the second end of the first tab. A second control has a first protuberance secured thereto for entrapment thereof within the second cage. A second tab has a first and a second extremity, the first extremity of the second tab being secured to a rear edge of the second slat, the second tab defining a first and a second recess. The first recess is disposed between the first and the second extremity of the second tab. The first control has a second bead secured thereto, the second bead being spaced from the first bead for entrapment thereof within the first recess. The second recess is disposed between the first recess and the second extremity of the second tab. Also, the second control has a second protuberance secured thereto for entrapment thereof within the second recess. The arrangement is such that when the first and second controls are moved relative to each other, the first and second slats are moved relative to each other between an open and a closed disposition thereof.

17 Claims, 6 Drawing Sheets

MINI-BLIND APPARATUS

CROSS REFERENCE TO RELATED APPLICATION

The present application is a continuation in part of application U.S. Ser. No. 09/977,447 filed Oct. 15, 2001 now U.S. Pat. No. 6,557,615. All the subject matter of U.S. Ser. No. 09/977,447 is incorporated herein by reference.

BACKGROUND OF THE INVENTION

1. Field of the Invention

The present invention relates to a mini-blind apparatus. More particularly, the present invention relates to a mini-blind apparatus having a first horizontal slat and a second slat disposed spaced and parallel relative to the first slat.

2. Background Information

Mini-blinds of various sizes are used for covering windows and the like so that when the mini-blind is closed, the blind serves as a curtain for screening the window. Typically, prior art mini-blinds have included a cord ladder for supporting each slat of the mini-blind. The ladder is supported at the upper end thereof by a frame so that when the ladder is manipulated, the slats are tilted from an open to a closed disposition thereof.

Also, a typical mini-blind further includes a lifting cord which passes through an aperture in each of the slats so that when the lifting cord is pulled, each of the slats, starting with the lowermost slat, is raised until all the slats are moved parallel relative to each other in an upward direction for permitting cleaning of the glass window therebehind.

However, because of the location of the ladders and the lifting cord extending through the slats, cleaning of the slats has proved to be a tedious and time consuming chore.

The present invention overcomes the aforementioned problem associated with the prior art mini-blind arrangements by having the controls and lifting cord located away from the slats so that cleaning of the slats is facilitated.

Therefore, it is a primary feature of the present invention to provide a mini-blind apparatus that overcomes the problems associated with the prior art arrangements.

Another feature of the present invention is the provision of a mini-blind apparatus that facilitates cleaning of the slats.

A further feature of the present invention is the provision of a mini-blind apparatus that reduces the cost of production of such apparatus.

Other features and advantages of the present invention will be readily apparent to those skilled in the art by a consideration of the detailed description of a preferred embodiment of the present invention contained herein.

SUMMARY OF THE INVENTION

The present invention relates to a mini blind apparatus having a first horizontal slat and a second slat disposed spaced and parallel relative to the first slat. The apparatus includes a first tab having a first and a second end, the first end of the first tab being secured to a rearward edge of the first slat, the first tab defining a first and a second cage. The first cage is disposed between the first and the second end of the first tab and a first control has a first bead secured thereto for entrapment thereof within the first cage.

The second cage is disposed between the first cage and the second end of the first tab. A second control has a first protuberance secured thereto for entrapment thereof within the second cage. A second tab has a first and a second extremity, the first extremity of the second tab being secured to a rear edge of the second slat, the second tab defining a first and a second recess. The first recess is disposed between the first and the second extremity of the second tab. The first control has a second bead secured thereto, the second bead being spaced from the first bead for entrapment thereof within the first recess.

The second recess is disposed between the first recess and the second extremity of the second tab. Also, the second control has a second protuberance secured thereto for entrapment thereof within the second recess. The arrangement is such that when the first and second controls are moved relative to each other, the first and second slats are moved relative to each other between an open and a closed disposition thereof.

In a more specific embodiment of the present invention, the first tab is fabricated from a plastics material.

The first tab is of elongate rectangular configuration, the first tab defining a first slot disposed in a vicinity of the first cage. The first slot has a first and a second termination and a first and a second side.

Moreover, the first cage includes a first portion extending from the first side of the first slot and disposed between the first and second termination. Also, a second portion extends from the second side of the first slot and is disposed between the first and second termination. A third portion extends from the second side of the first slot and is disposed between the first and second termination. The second and third portions define therebetween a first gap for the insertion therein of the first control, the portions cooperating with each other for the entrapment therein of the first bead.

Also, the first control is a cord and the first bead is fused onto the first control.

Furthermore, the first tab defines a second slot disposed in a vicinity of the second cage, the second slot having a first and a second end and a first and a second edge.

Additionally, the second cage includes a first part extending from the first edge of the second slot and disposed between the first and second end of the second slot. Also, a second part extends from the second edge of the second slot and is disposed between the first and second end of the second slot. A third part extends from the second edge of the second slot and is disposed between the first and second end of the second slot. The second and third parts define therebetween a second gap for the insertion therein of the second control, the parts cooperating with each other for the entrapment therein of the first protuberance.

Moreover, the second control is a further cord.

The second tab is of elongate rectangular configuration, the second tab defining a first channel disposed in a vicinity of the first recess. The first channel has a first and a second termination and a first and a second side.

Also, the first recess includes a first arm extending from the first side of the first channel and disposed between the first and second termination of the first channel. A second arm extends from the second side of the first channel and is disposed between the first and second termination of the first channel. A third arm extends from the second side of the first channel and is disposed between the first and second termination of the first channel. The second and third arms define therebetween a first opening for the insertion therein of the first control, the arms cooperating with each other for the entrapment therein of the second bead.

The second tab also defines a second channel which is disposed in a vicinity of the second recess, the second channel having a first and a second termination and a first and a second side.

Furthermore, the second recess includes a first extension extending from the first side of the second channel and disposed between the first and second termination of the second channel. A second extension extends from the second side of the second channel and is disposed between the first and second termination of the second channel. A third extension extends from the second side of the second channel and is disposed between the first and second termination of the second channel. The second and third extensions define therebetween a second opening for the insertion therein of the second control, the extensions cooperating with each other for the entrapment therein of the second protuberance.

The first tab includes a first element which extends from the first end of the first tab to the first termination of the first slot. Additionally, a second element extends from the first element to the second end of the first tab, the first element being offset relative to the second element.

Moreover, the second tab includes a first member which extends from the first extremity of the second tab to the first termination of the first channel of the second tab. A second member extends from the first member to the second end of the second tab, the first member being offset relative to the second member.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views and embodiments of the present invention.

DETAILED DESCRIPTION OF THE DRAWINGS

Figure 1:
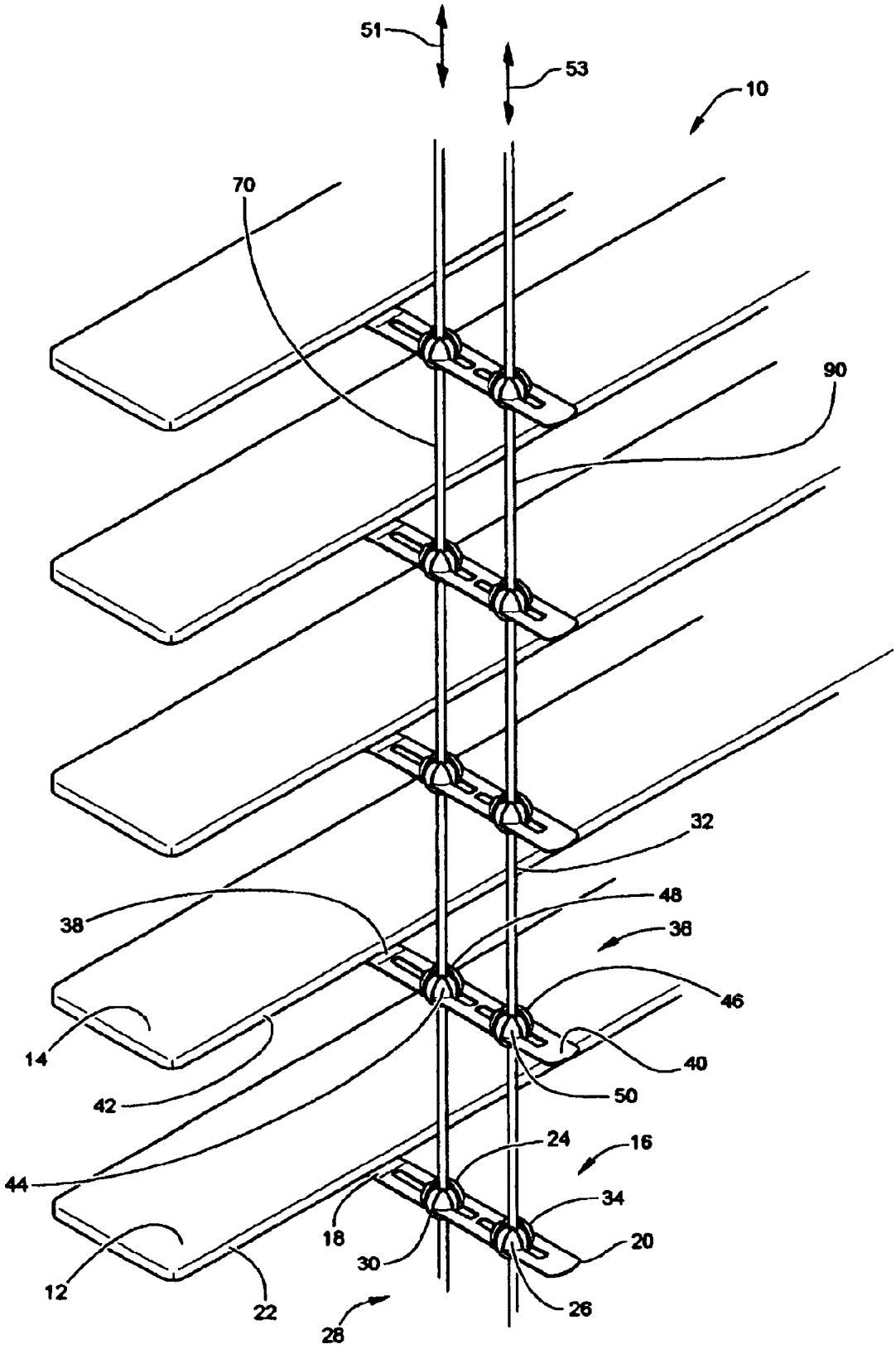
FIG. 1 is a fragmentary perspective view of a mini-blind apparatus according to the present invention.

FIG. 1 is a fragmentary perspective view of a mini-blind apparatus generally designated 10 according to the present invention. As shown in FIG. 1, the mini blind apparatus 10 has a first horizontal slat 12 and a second slat 14 disposed spaced and parallel relative to the first slat 12. The apparatus 10 includes a first tab generally designated 16 having a first and a second end 18 and 20 respectively, the first end 18 of the first tab 16 being secured to a rearward edge 22 of the first slat 12, the first tab 16 defining a first and a second cage 24 and 26 respectively. The first cage generally designated 24 is disposed between the first and the second end 18 and 20 respectively of the first tab 16 and a first control 28 has a first bead 30 secured thereto for entrapment thereof within the first cage 24.

The second cage generally designated 26 is disposed between the first cage 24 and the second end 20 of the first tab 16. A second control 32 has a first protuberance 34 secured thereto for entrapment thereof within the second cage 26.

A second tab generally designated 36 has a first and a second extremity 38 and 40 respectively, the first extremity 38 of the second tab 36 being secured to a rear edge 42 of the second slat 14, the second tab 36 defining a first and a second recess 44 and 46 respectively. The first recess 44 is disposed between the first and the second extremity 38 and 40 respectively of the second tab 36. The first control 28 has a second bead 48 secured thereto, the second bead 48 being spaced from the first bead 30 for entrapment thereof within the first recess 44.

The second recess 46 is disposed between the first recess 44 and the second extremity 40 of the second tab 36. Also, the second control 32 has a second protuberance 50 secured thereto for entrapment thereof within the second recess 46. The arrangement is such that when the first and second controls 28 and 32 respectively are moved relative to each other as indicated by the arrows 51 and 53 respectively, the first and second slats 12 and 14 respectively are moved relative to each other between an open and a closed disposition thereof.

Figure 2:
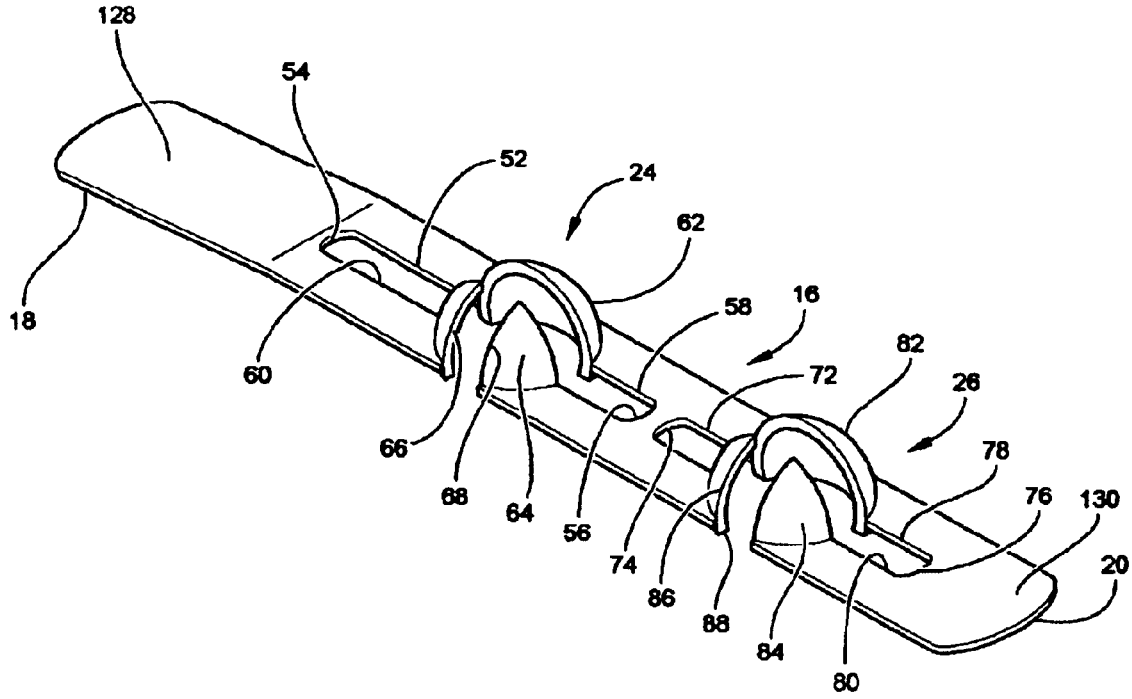
FIG. 2 is an enlarged perspective view of the first tab shown in FIG. 1.

FIG. 2 is an enlarged perspective view of the first tab 16 shown in FIG. 1. As shown in FIG. 2, the first tab 16 is of elongate rectangular configuration and is fabricated from a plastics material. The first tab 16 defines a first slot 52 disposed in a vicinity of the first cage 24. Also, the first slot 52 has a first and a second termination 54 and 56 respectively and a first and a second side 58 and 60 respectively.

Moreover, the first cage 24 includes a first portion 62 extending from the first side 58 of the first slot 52 and disposed between the first and second termination 54 and 56 respectively. Also, a second portion 64 extends from the second side 60 of the first slot 52 and is disposed between the first and second termination 54 and 56 respectively. A third portion 66 extends from the second side 60 of the first slot 52 and is disposed between the first and second termination 54 and 56 respectively. The second and third portions 64 and 66 respectively define therebetween a first gap 68 for the insertion therein of the first control 28 shown in FIG. 1, the portions 62, 64 and 66 cooperating with each other for the entrapment therein of the first bead 30 as shown in FIG. 1.

As shown in FIG. 1, the first control generally designated 28 is a cord 70 and the first bead 30 is fused onto the first control 28.

Furthermore, as shown in FIG. 2, the first tab 16 defines a second slot 72 disposed in a vicinity of the second cage 26, the second slot 72 having a first and a second end 74 and 76 respectively and a first and a second edge 78 and 80 respectively.

Additionally, the second cage generally designated 26 includes a first part 82 extending from the first edge 78 of the second slot 72 and disposed between the first and second end 74 and 76 respectively of the second slot 72. Also, a second part 84 extends from the second edge 80 of the second slot 72 and is disposed between the first and second end 74 and 76 respectively of the second slot 72. A third part 86 extends from the second edge 80 of the second slot 72 and is disposed between the first and second end 74 and 76 respectively of the second slot 72. The second and third parts 84 and 86 respectively define therebetween a second gap 88 for the insertion therein of the second control 32 as shown in FIG. 1, the parts 82, 84 and 86 respectively cooperating with each other for the entrapment therein of the first protuberance 34 shown in FIG. 1.

Moreover, the second control generally designated 32 is a further cord 90 as shown in FIG. 1.

Figure 3:
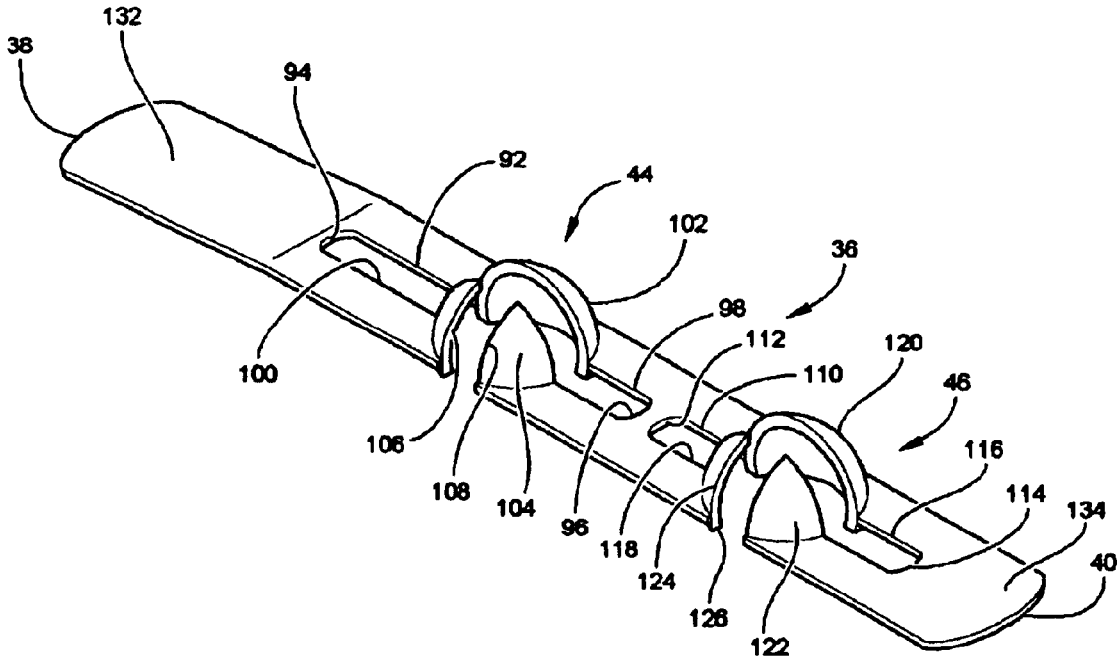
FIG. 3 is an enlarged perspective view of the second tab shown in FIG. 1.

FIG. 3 is an enlarged perspective view of the second tab 36 shown in FIG. 1. As shown in FIG. 3, the second tab generally designated 36 is of elongate rectangular configuration, the second tab 36 defining a first channel 92 disposed in a vicinity of the first recess 44. The first channel 92 has a first and a second termination 94 and 96 respectively and a first and a second side 98 and 100 respectively.

Also, the first recess generally designated 44 includes a first arm 102 extending from the first side 98 of the first channel 92 and disposed between the first and second termination 94 and 96 respectively of the first channel 92. A second arm 104 extends from the second side 100 of the first channel 92 and is disposed between the first and second termination 94 and 96 respectively of the first channel 92. A third arm 106 extends from the second side 100 of the first channel 92 and is disposed between the first and second termination 94 and 96 respectively of the first channel 92. The second and third arms 104 and 106 respectively define therebetween a first opening 108 for the insertion therein of the first control 28 as shown in FIG. 1, the arms 102, 104 and 106 respectively cooperating with each other for the entrapment therein of the second bead 48 shown in FIG. 1.

The second tab generally designated 36 also defines a second channel 110 which is disposed in a vicinity of the second recess 46, the second channel 110 having a first and a second termination 112 and 114 respectively and a first and a second side 116 and 118 respectively.

Furthermore, the second recess 46 includes a first extension 120 extending from the first side 116 of the second channel 110 and disposed between the first and second termination 112 and 114 respectively of the second channel 110. A second extension 122 extends from the second side 118 of the second channel 110 and is disposed between the first and second termination 112 and 114 respectively of the second channel 110. A third extension 124 extends from the second side 118 of the second channel 110 and is disposed between the first and second termination 112 and 114 respectively of the second channel 110. The second and third extensions 122 and 124 respectively define therebetween a second opening 126 for the insertion therein of the second control 32, the extensions 120, 122 and 124 respectively cooperating with each other for the entrapment therein of the second protuberance 50 shown in FIG. 1.

As shown in FIG. 2, the first tab 16 includes a first element 128 which extends from the first end 18 of the first tab 16 to the first termination 54 of the first slot 52. Additionally, a second element 130 extends from the first element 128 to the second end 20 of the first tab 16, the first element 128 being offset relative to the second element 130.

Moreover, as shown in FIG. 3, the second tab 36 includes a first member 132 which extends from the first extremity 38 of the second tab 36 to the first termination 94 of the first channel 92 of the second tab 36. A second member 134 extends from the first member 132 to the second extremity 40 of the second tab 36, the first member 132 being offset relative to the second member 134.

Figure 4:
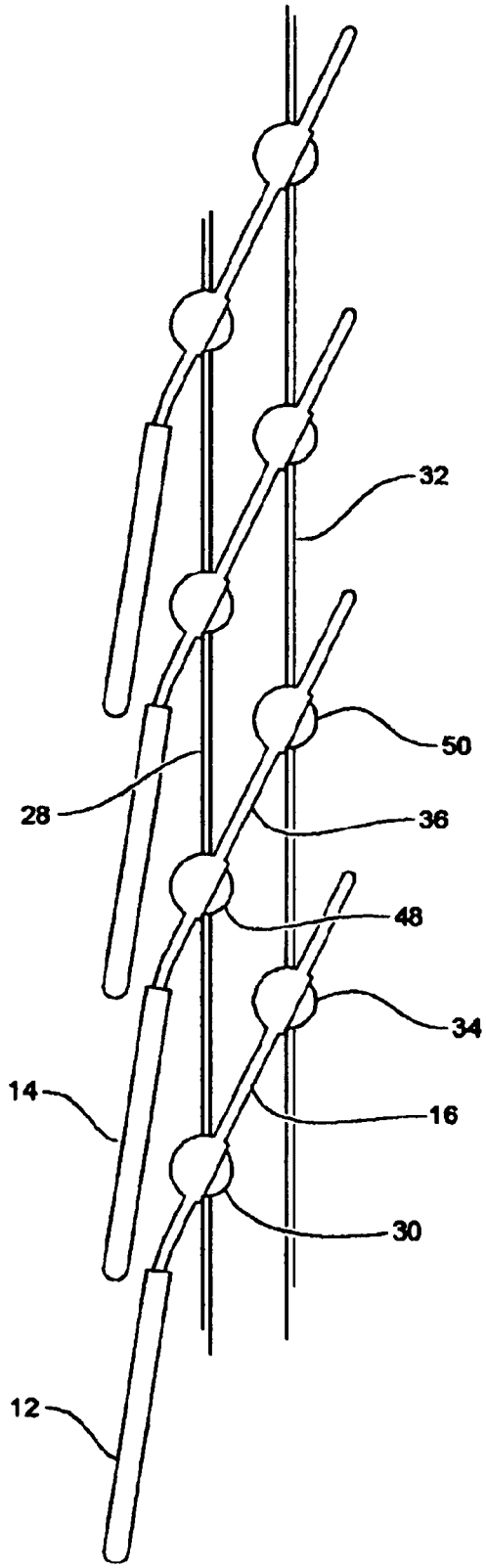
FIG. 4 is a side elevational view of the slats shown in FIG. 1 disposed in the closed disposition thereof.

FIG. 4 is a side elevational view of the slats 12 and 14 disposed in the closed disposition thereof.

Figure 5:
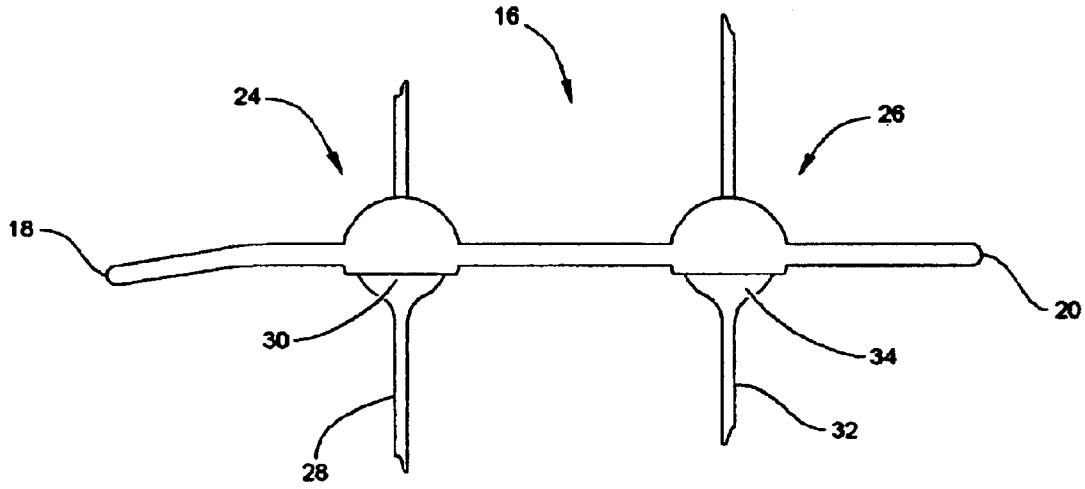
FIG. 5 is a side elevational view of the first tab; shown in FIG. 2.

FIG. 5 is a side elevational view of the first tab 16.

Figure 6:
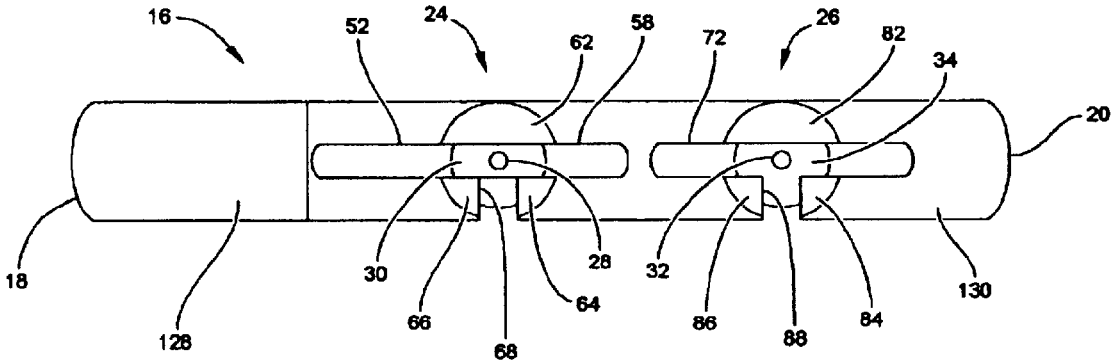
FIG. 6 is a top plan view of the first tab shown in FIG. 2.

FIG. 6 is a top plan view of the first tab 16 shown in FIG. 2. As shown in FIG. 6, the bead 30 is disposed within the first cage 24 and the first protuberance is disposed within the second cage 26.

In operation of the apparatus 10 according to the present invention, the first control 28 is inserted into the first gap 68 of the first tab 16 and is pulled until the first bead 30 is entrapped within the first cage 24. Similarly, the first control 28 is threaded through the first opening 108 and is then pulled until the second bead 48 is entrapped within the first recess 44 of the second tab 36. Also, the second control 32 is threaded through the second gap 88 of the first tab 16 and is pulled to entrap or lock the first protuberance 34 within the second cage 26. Also the second control cord 32 is threaded through the second opening 126 of the second tab 36 and is then pulled until the second protuberance 50 is locked within the second recess 46. The aforementioned operation is accomplished during manufacture of the blind apparatus 10. This operation may be accomplished by suitable mechanical means until all the tabs for each of the slats are connected to the controls 28 and 32 respectively. The apparatus 10 is also provided with a third control cord (not shown) which slidingly extends through each of the tabs so that when the third cord is pulled, all of the tabs and the slats attached thereto are raised for lifting the slats together relative to a window or the like.

The present invention provides a unique mini-blind apparatus which is easily manufactured and which is of relatively low cost and which facilitates cleaning of the slats thereof.

What is claimed is:

1. A mini-blind apparatus having a first horizontal slat and a second slat disposed spaced and parallel relative to the first slat, said apparatus comprising:

a first tab having a first and a second end, said first end of said first tab being secured to a rearward edge of the first slat, said first tab defining a first and a second cage;

said first cage being disposed between said first and said second end of said first tab;

a first control having a first bead secured thereto for entrapment thereof within said first cage;

said second cage being disposed between said first cage and said second end of said first tab;

a second control having a first protuberance secured thereto for entrapment thereof within said second cage;

a second tab having a first and a second extremity, said first extremity of said second tab being secured to a rear edge of the second slat, said second tab defining a first and a second recess;

said first recess being disposed between said first and said second extremity of said second tab;

said first control having a second bead secured thereto, said second bead being spaced from said first bead for entrapment thereof within said first recess;

said second recess being disposed between said first recess and said second extremity of said second tab; and said second control having a second protuberance secured thereto for entrapment thereof within said second recess, the arrangement being such that when said first and second controls are moved relative to each other, the first and second slats are moved relative to each other between an open and a closed disposition thereof.

2. A mini-blind apparatus as set forth in claim 1 wherein said first tab is fabricated from plastics material.

3. A mini-blind apparatus as set forth in claim 1 wherein said first tab is of elongate rectangular configuration, said first tab defining a first slot disposed in a vicinity of said first cage, said first slot having a first and a second termination and a first and a second side.

4. A mini-blind apparatus as set forth in claim 3 wherein said first cage includes:

a first portion extending from said first side of said first slot and disposed between said first and second termination;

a second portion extending from said second side of said first slot and disposed between said first and second termination;

a third portion extending from said second side of said first slot and disposed between said first and second termination, said second and third portions defining therebetween a first gap for the insertion therein of said first control, said portions cooperating with each other for the entrapment therein of said first bead.

5. A mini-blind apparatus as set forth in claim 1 wherein said first control is a cord.

6. A mini-blind apparatus as set forth in claim 1 wherein said first bead is fused onto said first control.

7. A mini-blind apparatus as set forth in claim 1 wherein said first tab is of elongate rectangular configuration, said first tab defining a second slot disposed in a vicinity of said second cage, said second slot having a first and a second end and a first and a second edge.

8. A mini-blind apparatus as set forth in claim 7 wherein said second cage includes:

a first part extending from said first edge of said second slot and disposed between said first and second end of said second slot;

a second part extending from said second edge of said second slot and disposed between said first and second end of said second slot;

a third part extending from said second edge of said second slot and disposed between said first and second end of said second slot, said second and third parts defining therebetween a second gap for the insertion therein of said second control, said parts cooperating with each other for the entrapment therein of said first protuberance.

9. A mini-blind apparatus as set forth in claim 1 wherein said second control is a further cord.

10. A mini-blind apparatus as set forth in claim 1 wherein said second tab is of elongate rectangular configuration, said second tab defining a first channel disposed in a vicinity of said first recess, said first channel having a first and a second termination and a first and a second side.

11. A mini-blind apparatus as set forth in claim 10 wherein said first recess includes:

a first arm extending from said first side of said first channel and disposed between said first and second termination of said first channel;

a second arm extending from said second side of said first channel and disposed between said first and second termination of said first channel;

a third arm extending from said second side of said first channel and disposed between said first and second termination of said first channel, said second and third arms defining therebetween a first opening for the insertion therein of said first control, said arms cooperating with each other for the entrapment therein of said second bead.

12. A mini-blind apparatus as set forth in claim 1 wherein said second tab is of elongate rectangular configuration, said second tab defining a second channel disposed in a vicinity of said second recess, said second channel having a first and a second termination and a first and a second side.

13. A mini-blind apparatus as set forth in claim 1 wherein said second recess includes:

a first extension extending from said first side of said second channel and disposed between said first and second termination of said second channel;

a second extension extending from said second side of said second channel and disposed between said first and second termination of said second channel;

a third extension extending from said second side of said second channel and disposed between said first and second termination of said second channel, said second and third extensions defining therebetween a second opening for the insertion therein of said second control, said extensions cooperating with each other for the entrapment therein of said second protuberance.

14. A mini-blind apparatus as set forth in claim 3 wherein said first tab includes:

a first element which extends from said first end of said first tab to said first termination of said first slot;

a second element which extends from said first element to said second end of said first tab, said first element being offset relative to said second element.

15. A mini-blind apparatus as set forth in claim 10 wherein said second tab includes:

a first member which extends from said first extremity of said second tab to said first termination of said first channel;

a second member which extends from said first member to said second end of said second tab, said first member being offset relative to said second member.

16. A mini-blind apparatus having a first horizontal slat and a second slat disposed spaced and parallel relative to the first slat, said apparatus comprising:

a first tab having a first and a second end, said first end of said first tab being secured to a rearward edge of the first slat, said first tab defining a first and a second cage;

said first cage being disposed between said first and said second end of said first tab;

a first control having a first bead secured thereto for entrapment thereof within said first cage;

said second cage being disposed between said first cage and said second end of said first tab;

a second control having a first protuberance secured thereto for entrapment thereof within said second cage;

a second tab having a first and a second extremity, said first extremity of said second tab being secured to a rear edge of the second slat, said second tab defining a first and a second recess;

said first recess being disposed between said first and said second extremity of said second tab;

said first control having a second bead secured thereto, said second bead being spaced from said first bead for entrapment thereof within said first recess;

said second recess being disposed between said first recess and said second extremity of said second tab;

said second control having a second protuberance secured thereto for entrapment thereof within said second recess, the arrangement being such that when said first and second controls are moved relative to each other, the first and second slats are moved relative to each other between an open and a closed disposition thereof; and said beads being fused onto said first control and said protuberances being fused onto said second control.

17. A mini-blind apparatus having a first horizontal slat and a second slat disposed spaced and parallel relative to the first slat, said apparatus comprising:

a first tab having a first and a second end, said first end of said first tab being secured to a rearward edge of the first slat, said first tab defining a first and a second cage;

said first cage being disposed between said first and said second end of said first tab;

a first control having a first bead secured thereto for entrapment thereof within said first cage;

said second cage being disposed between said first cage and said second end of said first tab;

a second control having a first protuberance secured thereto for entrapment thereof within said second cage;

a second tab having a first and a second extremity, said first extremity of said second tab being secured to a rear edge of the second slat, said second tab defining a first and a second recess;

said first recess being disposed between said first and said second extremity of said second tab;

said first control having a second bead secured thereto, said second bead being spaced from said first bead for entrapment thereof within said first recess;

said second recess being disposed between said first recess and said second extremity of said second tab;

said second control having a second protuberance secured thereto for entrapment thereof within said second recess, the arrangement being such that when said first and second controls are moved relative to each other, the first and second slats are moved relative to each other between an open and a closed disposition thereof;

said first tab being fabricated from a plastics material;

said first tab being of elongate rectangular configuration, said first tab defining a first slot disposed in a vicinity of said first cage, said first slot having a first and a second termination and a first and a second side;

said first cage including:

a first portion extending from said first side of said first slot and disposed between said first and second termination;

a second portion extending from said second side of said first slot and disposed between said first and second termination;

a third portion extending from said second side of said first slot and disposed between said first and second termination, said second and third portions defining therebetween a first gap for the insertion therein of said first control, said portions cooperating with each other for the entrapment therein of said first bead;

said first control being a cord;

said first bead being fused onto said first control;

said first tab being of elongate rectangular configuration, said first tab defining a second slot disposed in a vicinity of said second cage, said second slot having a first and a second end and a first and a second edge;

said second cage including:

a first part extending from said first edge of said second slot and disposed between said first and second end of said second slot;

a second part extending from said second edge of said second slot and disposed between said first and second end of said second slot;

a third part extending from said second edge of said second slot and disposed between said first and second end of said second slot, said second and third parts defining therebetween a second gap for the insertion therein of said second control, said parts cooperating with each other for the entrapment therein of said first protuberance;

said second control is a further cord;

said second tab being of elongate rectangular configuration, said second tab defining a first channel disposed in a vicinity of said first recess, said first channel having a first and a second termination and a first and a second side;

said first recess including:

a first arm extending from said first side of said first channel and disposed between said first and second termination of said first channel;

a second arm extending from said second side of said first channel and disposed between said first and second termination of said first channel;

a third arm extending from said second side of said first channel and disposed between said first and second termination of said first channel, said second and third arms defining therebetween a first opening for the insertion therein of said first control, said arms cooperating with each other for the entrapment therein of said second bead;

said second tab is of elongate rectangular configuration, said second tab defining a second channel disposed in a vicinity of said second recess, said second channel having a first and a second termination and a first and a second side;

said second recess including:

a first extension extending from said first side of said second channel and disposed between said first and second termination of said second channel;

a second extension extending from said second side of said second channel and disposed between said first and second termination of said second channel;

a third extension extending from said second side of said second channel and disposed between said first and second termination of said second channel, said second and third extensions defining therebetween a second opening for the insertion therein of said second control, said extensions cooperating with each other for the entrapment therein of said second protuberance;

said first tab including:

a first element which extends from said first end of said first tab to said first termination of said first slot;

a second element which extends from said first element to said second end of said first tab, said first element being offset relative to said second element;

said second tab including:

a first member which extends from said first extremity of said second tab to said first termination of said first channel; and a second member which extends from said first member to said second end of said second tab, said first member being offset relative to said second member.

* * * * *